United States Patent [19]

Rambousek et al.

[11] 4,393,648

[45] Jul. 19, 1983

[54] FIBER-GUIDING ELEMENT FOR OPEN END SPINNING MACHINES

[75] Inventors: Miroslav Rambousek, Ústí n Orl; Stanislav Švarc, Dolni Dobrouc, both of Czechoslovakia

[73] Assignee: Elitex, koncern textilniho strojirenstvi, Liberec, Czechoslovakia

[21] Appl. No.: 300,598

[22] Filed: Sep. 9, 1981

[30] Foreign Application Priority Data

Sep. 11, 1980 [CS] Czechoslovakia ..... 6157-80

[51] Int. Cl.[3] ..... D01H 7/882

[52] U.S. Cl. ..... 57/413

[58] Field of Search ..... 57/404, 408, 412, 413

[56] References Cited

U.S. PATENT DOCUMENTS 3,457,716 7/1969 Storek et al. ..... 57/413 X 3,538,698 11/1970 Ripka et al. ..... 57/413

3,834,148 9/1974 Sakurai et al. ..... 57/413

*Primary Examiner*—John Petrakes

[57] ABSTRACT

A fiber-guiding element for open end spinning machines through which separated fibers are directed into the spinning rotor. The rotor may be rotated in either direction for the purpose of forming either yarn with a left-hand twist or yarn with a right-hand twist. In accordance with the invention, the rear directing wall of said fiber-guiding element, which is symmetrical relative to the longitudinal axis of the element, is directed substantially tangential to the retreating collecting surface of the spinning rotor when the rotor is rotated in a first direction, while the opposite, front directed wall of the fiber-guiding element at the side of the exit opening therein is directed toward the other side substantially tangential relative to the retreating collecting surface of the spinning rotor when the rotor is rotated in the second, reverse direction.

4 Claims, 2 Drawing Figures

FIBER-GUIDING ELEMENT FOR OPEN END SPINNING MACHINES

Figure 1:
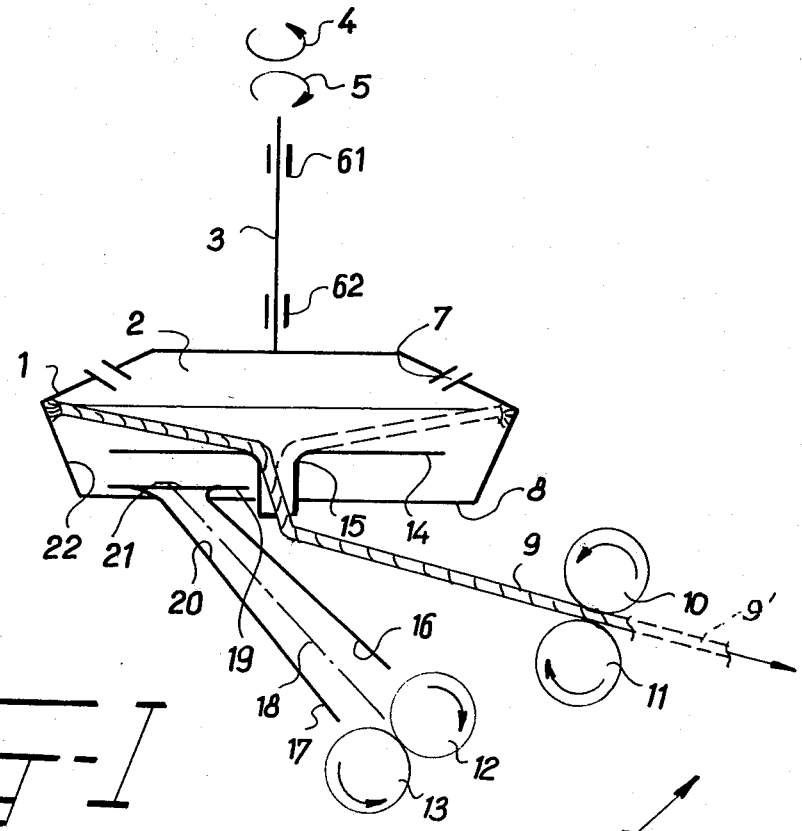

The present invention relates to a fiber-guiding element for open end spinning machines. Such guiding element is a channel provided in the stationary cover of the spinning rotor of the machine, the separate fibers, which are carried by the air jet from the fiber-separating mechanism, being introduced into the rotating spinning rotor through such fiber-guiding element. The rotating spinning rotor has an asymmetrically disposed collecting surface, the rotor being selectively rotated either in a clockwise or a counterclockwise direction so as to produce yarn with either a right-hand or a left-hand twist.

In the open end spinning machine art, it is known that the correct directing of the separated fibers fed into the spinning rotor is of great importance for the purpose of obtaining optimum yarn properties and of preventing involuntary yarn breakages. Therefore, great attention has been devoted to the dimensions, as well as to the position of the fiber-guiding relative to the collecting surface of the spinning rotor. This was the reason which caused the design of prior art fiber-guiding elements which are axially directed substantially in a tangential direction relative to the advancing collecting surface of the rotating spinning rotor.

Because of this, in accordance with the prior art, the separated fibers during operation of the machine are also fed in a tangential direction toward the advancing collecting surface of the rotating spinning rotor, in which they are formed to yarn in a known manner. The yarn is simultaneously withdrawn from the spinning rotor by withdrawing means, and is guided along the geometrical axis of the spinning rotor, this adequately assisting the imparting of twist to the yarn. The appurtenant yarn twist type is determined by whether the vector of the withdrawing force is directed outwardly from the spinning rotor on the side of its front or on the side of its back. In practice, a given machine type is usually modified for only one direction of withdrawing force. This means that in said machine, yarn with only one twist type can be produced.

However, for the purpose of satisfying the interest of the processing industry or yarns with right-hand twists as well as for yarns with left-hand twist, and to facilitate in this connection the processing of the required yarn types, the prior art machines can be modified by changing right-hand twist to left-hand twist and vice versa by means of replaceable machine parts comprising the appurtenant embodiment of the fiber-guiding element. However, such change has certain disadvantages, namely, the length of time required to replace the guiding elements, and also the expense necessitated by the provision of a very precise mounting for the fiber-guiding element.

These disadvantages have been partially overcome by another, already known invention (Czechoslovak Pat. No. 158,207), according to which the fiber-feeding, i.e., the fiber-guiding element, is selectively adjustable in accordance with the selected direction of rotation of the spinning rotor, assuming that the rotor can be selectively rotated in either direction. In this manner, a relatively simple change of position of the fiber-guiding element is made relative to the necessity of processing yarn with one or the other appurtenant twist directions. Nevertheless, in consequence of the existing movable parts in the fiber-transporting area, there is the danger that in the case of their inaccurate mounting, fibers are caught up on the projecting edges, thus forming the fiber agglomerates which, upon being fed to the spinning rotor, cause an interruption of the spinning process. This means that severe demands are put not only upon the construction of the fiber-guiding element, but also upon the accuracy of its processing as well as of the appurtenant points of mounting; again, this causes an increase in the expense of providing and operating the machine.

Moreover, such embodiment of fiber-guiding element requires a space which is not available in the fiber-transporting area, due to a frequent economical mutual arrangement of the fiber-separating mechanism and the spinning rotor. Its application is, therefore, possible only in certain specific arrangements. However, even with these there may arise difficulties, since it is necessary to take into account particularities in design not only with the part carrying the fiber-guiding element, but also those parts by means of which the readjustment of the fiber-guiding element from one extreme position to the other is made possible, as well as its being affixed in such positions.

The above outlined disadvantages of the prior art are mitigated by the present invention. In accordance with the invention, the fiber-guiding element is provided in a stationary front lid of the spinning rotor, the fiber-guiding element introducing the separated fibers into the rotating spinning rotor, such rotor having an asymmetrically disposed collecting surface. The spinning rotor, in according with the present invention, may be selectively rotated in either direction, so as to form yarn with either a right-hand twist or a left-hand twist. In accordance with the invention, while the left directing wall, which is symmetrical according to the longitudinal axis of the fiber-guiding element, is directed substantially in a tangential direction relative to the advancing collecting surface of the rotating spinning rotor, the oppositely arranged right directing wall of the fiber-guiding element at the side of the exit opening is directed toward the opposite side, in accordance with the opposite direction of rotation of the spinning rotor.

The right directing wall at the side of the exit opening is advantageously provided with an arcuate bend.

According to a further embodiment of the present invention, the exit opening is provided relative to the plane of the left directing wall with a section curves to the left in a gentle arc which is an immediate continuation of the neighboring parts of the left directing wall.

The advantage of the fiber-guiding element according to the present invention consists particularly in its simplicity of design, which makes it possible to manufacture it and to use it without an increase in expense. This is particularly important when considering the number of these fiber-guiding elements required in open end spinning machines. Moreover, it is possible to feed by means of said elements fibers into the spinning rotor with a selective sense of rotation for the purpose of forming right-hand twisted yarn as well as left-hand twisted yarn, without the necessity of changing the conditions of the yarn spinning process with the exception of a change in the direction of rotation of the spinning rotor.

Figure 2:
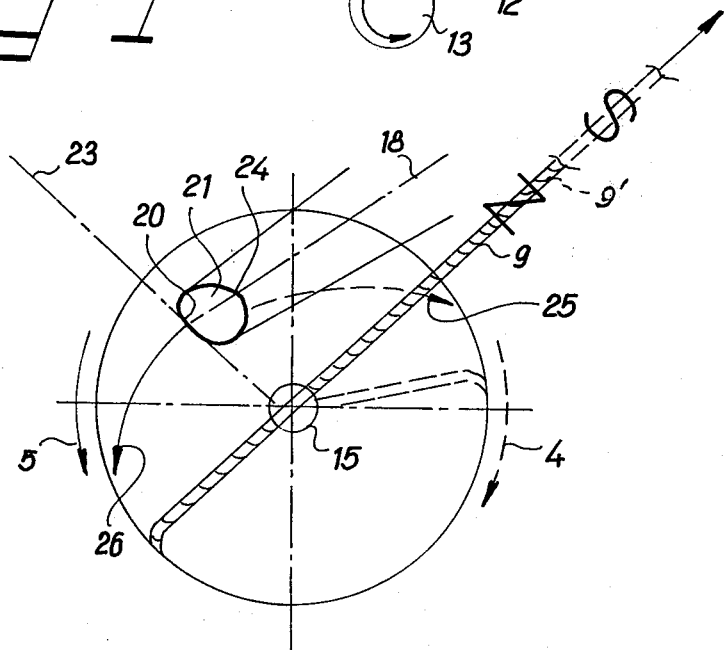

An embodiment of the fiber-guiding element according to the present invention by way of preferred example is shown in the accompanying drawing, in which:

FIG. 1 is a schematic view in longitudinal section through the spinning rotor of an open end spinning machine provided with the fiber-guiding element of the invention, and FIG. 2 is a schematic view in plan of the apparatus of FIG. 1 showing the exit orifice of the fiber-guiding element with relation to the collecting surface of the spinning rotor.

In open end spinning machines, the spinning and twisting element is constituted by a spinning rotor combined with a fiber-guiding element arranged in the geometrical axis of the spinning rotor, i.e., within the yarn-withdrawal path.

In FIG. 1, the said spinning rotor 1 is shown with its axis disposed vertically. Rotor 1 as represented is one of a number of known embodiments of spinning rotor, in which the collecting surface 22 for the fibers is made in the form of an inner conical surface with its minimum diameter at the lower or front opening 8 in the rotor. The rotor 1 is mounted for rotation in bearings 61, 62 by means of an axially disposed shaft 3 connected to the top 2 of the rotor, the shaft 3 being driven by means of a driving means (not shown) either in the direction 4 or in the opposite direction 5, both such directions being shown by curved arrows.

To the bottom opening 8 of the spinning rotor 1 there is attached a stationary lid, not shown. In this lid there is disposed a guiding element 17 for introducing the separated fibers by the fiber-separating element, e.g., by means of fiber-separating rollers 12 and 13, the guiding element 17 having an exit opening 21 within the lower end of the spinning rotor 1. Further, a fiber-guiding element 15 is arranged centrally in the lid, element 15 passing inside the spinning rotor 1 to be connected to a disc 14 which divides the space within the spinning rotor 1 into a lower space for introducing the separated fibers, and an upper space for withdrawing the yarn 9 manufactured by the spinning rotor. The yarn 9 is withdrawn through the guide 15 by means of a pair of opposed pinch rollers 10,11.

In the exemplary embodiment, the fiber-guiding element 17 is made in the form of a channel, the (left FIG. 1) directing wall 20 of which and the (right FIG. 1) directing wall 16 of which being symmetrical relative to the longitudinal axis 18 of such guiding element 17. The said longitudinal axis 18 of the fiber-guiding element 17 is skewed relative to the axis of rotation of the spinning rotor 1, and is also simultaneously inclined at an acute angle relative to the plane of the front opening 8 of the spinning rotor 1. Consequently the left directing wall 20 of the fiber-guiding element 17, as well as the right directing wall 16 thereof, are directed in a substantially tangential direction relative to the collecting surface 22 of the spinning rotor 1. However, according to the present invention, the right directing wall 16 at the side of the exit opening 21 of the fiber-guiding element 17 is directed toward the opposite side in accordance with the direction of rotation of the rotor 1 as shown by the dash-line arrow 4 (FIG. 2), and has an arcuate bend 19 at that point. Moreover, the exit opening 21 of the fiber-guiding element 17 relative to the plane 23 (FIG. 2) of the left directing wall 20 curves to the left in a gentle arc, which immediately continues the neighboring parts of the left directing wall 20.

It will be assumed that upon operation of the open end spinning machine in a first mode, the spinning rotor 1 is driven counterclockwise in the direction of arrow 5 (FIG. 2). Consequently, as is generally known, an under-pressure arises inside the spinning rotor 1 by the action of the vents 7 therein, thus causing an appropriate air flow through the fiber-guiding element 17. This air flow, which is straight inside the fiber-guiding element 17, because of the high speed of rotation of the spinning rotor 1, is converted to a rotary flow, the direction of which is the same as that of the rotation of the spinning rotor 1. Thus the separated fibers, fed into the fiber-guiding element 17 from the fiber-separating rollers 12,13 by the action of said air flow, are directed by the left (FIG. 2) directing wall 20 of the fiber-guiding element 17 in the direction of the arrow 26 in FIG. 2. In consequence of their being directed by the fiber-guiding element 17, the separated fibers are guided toward the advancing collecting surface 22 of the spinning rotor 1, sliding thereabout due to centrifugal force toward its maximum diameter, at which the characteristic fiber ribbon is formed therefrom. From such fiber ribbon, yarn 9 is withdrawn by a pair of withdrawing pinch rollers 10,11. Because the yarn 9 is withdrawn, with the given direction of rotation of the spinning rotor 1 by a force the vector of which is directed from the spinning rotor 1 at the side of its front opening 8, a right-hand twist z is imparted to the yarn 9 as is indicated in the full-line rendition of such yarn.

When it is necessary to form yarn with a left-hand twist S, it is necessary only to change the direction of rotation of the spinning rotor 1 to cause it to rotate in the direction of the curved arrow 4 (clockwise in FIG. 2). The direction of the rotational flow of air in the spinning rotor 1 is changed accordingly. The separated fibers which are fed from the fiber-separating rollers 12,13, the position of which remains unchanged, are now carried by the air flow and directed to the wall 16 (right, FIG. 2) of the fiber-guiding element 17 in the direction of the arrow 25 (FIG. 2), in accordance with the selected new direction of rotation of spinning rotor 1. Such fibers are again transformed to yarn, indicated by the broken line 9', which, however, has the required left-hand twist S.

In order to direct the fibers without any failure arising from an abrupt change in the direction movement of the fibers due to the position of the fiber-guiding element 17 relative to the plane of the front opening 8 of the spinning rotor 1, the frontal directing wall 16 of such guide is provided at the side of the exit opening 21 with a fairly abrupt arcuate bend 19. The directing effect upon the fibers in the area of the exit opening 21 of the fiber-guiding 17 is still further increased by means of the concave section 24 thereof, which prevents an uncontrollable dissipation of the fibers.

The fiber-guiding element 17 according to the present invention is simple, inexpensive in its manufacture, and sufficient for introducing separated fibers into the spinning rotor 1 for the purpose of selectively manufacturing either right-hand twist yarn or left-hand twist yarn, depending only upon the direction of rotation of the spinning rotor.

Although the invention is illustrated and described with reference to one preferred embodiment thereof, it is to be expressly understood that it is in no way limited to the discosure of such preferred embodiment but is capable of numerous modifications within the scope of the appended claims.

We claim:

1. In an open-end spinning machine having a hollow spinning rotor which may be rotated in either direction for the purpose of forming either yarn with a left-hand twist or yarn with a right-hand twist, the improvement which comprises a fiber-guiding element having an exit opening through which separated fibers are directed into the spinning rotor, the guiding element being fixedly mounted with respect to the rotor and having a left fiber-directing wall and a right fiber-directing wall, the left fiber-directing wall of said fiber-guiding element being oriented in a first direction substantially tangential to the then retreating collecting surface of the spinning rotor when the rotor is rotating in one direction, the opposite, right fiber-directing wall of the fiber-guiding element at the exit opening thereof within the rotor being oriented in a second direction opposite the said one direction and substantially tangential relative to the then retreating collecting surface of the spinning rotor when the rotor is rotating in the other, reverse direction.

2. The combination set forth in claim 1, comprising a stationary lid on the spinning rotor, and wherein the guiding element is fixedly mounted on said lid.

3. The combination set forth in claim 1, wherein the right, fiber-directing wall on the side of the exit opening thereof is provided with an arcuate bend.

4. The fiber-guiding element as set forth in claim 1, wherein the wall of the exit opening thereof is bent away from the longitudinal axis of the element at both the left and right fiber-directing walls as the element extends progressively further into the space within the rotor.

* * * * *